United States Patent [19]

Lecat

[11] Patent Number: 5,029,773

[45] Date of Patent: Jul. 9, 1991

[54] CABLE TOWED DECOY WITH COLLAPSIBLE FINS

[75] Inventor: Robert J. Lecat, Centerport, N.Y.

[73] Assignee: Grumman Aerospace Corporation, Bethpage, N.Y.

[21] Appl. No.: 469,123

[22] Filed: Jan. 24, 1990

[51] Int. Cl.[5] ..... F42B 10/14

[52] U.S. Cl. ..... 244/3.28; 244/1 TD; 244/14

[58] Field of Search ..... 102/385, 386, 388, 387; 244/14, 3.28, 3.3, 1 TD, 110 D, 113

[56] References Cited

U.S. PATENT DOCUMENTS

| | | | |
|---|---|---|---|
| 3,250,499 | 5/1966 | Carroll | 244/113 |
| 3,492,011 | 2/1970 | Adams | 102/388 |
| 3,695,177 | 10/1972 | Chakoian et al. | 102/386 |
| 3,857,338 | 12/1974 | Bucklish | 102/387 |
| 4,624,424 | 11/1986 | Pinson | 102/388 |
| 4,852,455 | 8/1989 | Brum | 244/1 TD |

OTHER PUBLICATIONS

Hoerner, S. F., "Fluid Dynamic Drag," published by the author, 1965.

Philipps, William H., "Theoretical Analysis of Oscillations of a Tow Cable", N.A.C.A. T.N. 1796, 1949.

Carroll, D., "Parametric Design and Analyses of Target Tow Lines," NADC Report 74151-30 AO #786 695.

Matuk, "Flight Tests of Tow Wire Forces While Flying a Race Track Pattern," A.I.A.A. Journal of Aircraft, vol. 20, No. 7, Jul. 1983, pp. 623-626.

*Primary Examiner*—Michael J. Carone

*Attorney, Agent, or Firm*—Pollock, VandeSande & Priddy

[57] ABSTRACT

The invention extends the operational envelope of towed bodies at high altitudes and at high dynamic pressures. It features fins with large span/chord ratios, compactly stowed along the body surface, pivotally swept back with their chord broadside to the airstream. These fins generate high drag forces and large stabilizing and damping moments, even at supersonic speeds. Sweepback angles, controlled by elastic restraints, increase as fin loads increase. This minimizes variations in cable tension, even in maneuvers. Fin drag forces can also extend telescopic body elements. Fin settings can also generate vertical or lateral forces to bias decoy position.

9 Claims, 1 Drawing Sheet

CABLE TOWED DECOY WITH COLLAPSIBLE FINS

FIELD OF THE INVENTION

The present invention relates to cable-towed bodies, increasing the maximum altitude and the maximum dynamic pressure limits of their operational envelope. It is also compatible with stringent decoy packaging and operational requirements.

BACKGROUND OF THE INVENTION

Decoys are often used in combat to confuse enemy aircrafts and ships and spoil the aim of their weapons. To increase decoy useful life and also to separate or offset the decoy from the craft, cable-towed decoys are often preferred.

To operate at high altitudes/low densities increases in drag parameter $C_DS$ or equivalent flat plate area "S" are required to damp cable oscillations and avoid cable instabilities. Cable tension increases with speed and dynamic pressure, then operations are limited by cable strength at high dynamic pressures. Further, violent evasive maneuvers represent very large additional excursions from steady state cable tension values, the so-called "whip" effect, resulting in additional restrictions on the decoy operational envelope.

Two conditions must be improved: the ability to get large decoy forces, mostly from large equivalent flat plate areas, even in maneuvers at high altitudes and low speeds, and also the ability to modulate decoy forces to avoid breaking the cable at high dynamic pressures.

Parachutes can generate very large drag forces but force modulation is a big problem and they also interfere with critical decoy requirements in the rear quadrant. Negative lift forces could also be considered to increase the pull at the end of the cable. But, lift forces are very sensitive to angle of attack, controlled by the pitching moments generated by cable forces relative to the center of gravity. Substantial variations are expected since the cable angle at the decoy is very sensitive to conditions and can easily vary 45° or more. Difficult packaging also a major problem, and at supersonic speeds, their effectiveness decreases with increasing mach number.

Thus, we are looking for impact or streamwise forces, generated by solid aerodynamic surfaces which can be controlled and yet will not interfere with radiation or signals from the base of the decoy.

Fins matching the body contour can be nearly as long as the body, thus featuring high span to chord ratios giving very large coefficients approaching two-dimensional optimum values, and also a vary large total area when a plurality of fins represents a good percentage of the body surface area. Packaging problems become manageable. Force modulation also becomes relatively simple when these fins are always in a swept-back configuration. Increasing fin forces will increase sweepback angles which tend to decrease fin and decoy drag levels, minimizing changes in cable tension.

BRIEF DESCRIPTION OF THE INVENTION

The present invention is characterized by deployable fins packaged along the body contours and/or the spaces available between the decoy body and the walls of the canister, where the decoy is stowed. They are hinged about the rear of the body periphery and deployed broadside to the free stream in a swept-back configuration.

When the body is released or the decoy is ejected, the swept-back angle of the fins is constrained by an elastic restraint, e.g. a spring-loaded stem or cable which couples fin forces and fin sweepback angles. Any fin drag increase stretches the restraint, increasing fin sweepback which reduces fin drag coefficients, tending to keep drag levels constant.

The fins are characterized by generally high aspect ratios (span/chord), deployed with their chord broadside to the wind rather than streamwise like airfoils. Thus, they feature, when deployed normal to the free stream, high section normal force coefficients particularly for fins matching body contours which, when deployed, feature cross sections concave to the incoming wind.

The aerodynamic forces, mostly normal to the fin planform, generate large drag forces as well as large stabilizing and damping moments, even at supersonic speeds. Body oscillations and/or jitter in the radiated signals are minimized.

The large fin drag forces available, particularly during fin deployment can be advantageously used to deploy or extend a telescopic extension of the body. This increases the distance between the fin forces and the center of gravity, increasing stabilizing moments and more particularly damping moments which vary as the square of this distance. Other decoy design parameters, e.g. antenna separation, may also make the telescoping decoy body a desirable and at times mandatory design condition.

Specific fin settings and orientations can also be selected to give not only drag forces but also forces in the vertical or lateral directions if desired.

BRIEF DESCRIPTION OF THE FIGURES

The above-mentioned objects and advantages will be more clearly understood when considered in conjunction with the accompanying drawings in which.

DETAILED DESCRIPTION OF THE INVENTION

Figure 1:
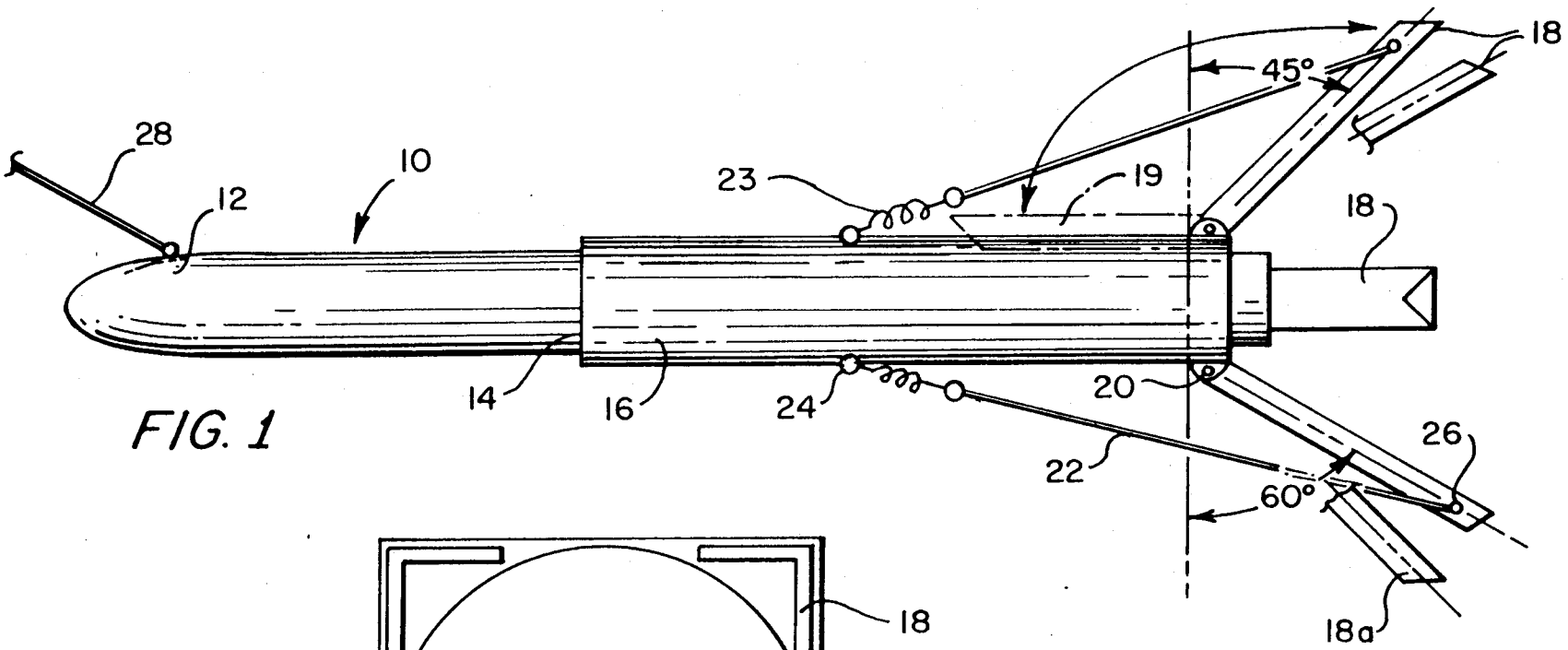
FIG. 1 is a simplified diagrammatic elevational view of a decoy in accordance with the present invention.

Referring to FIG. 1 the decoy of the present invention is generally indicated by reference numeral 10. It includes a nose cone section 12 and a median section 14. The latter-mentioned median section 14 may telescope within a rear section 16. The median and end sections are cylindrically shaped. Four fins 18 are pivotally mounted to the rear section and provide aerodynamic stability when the decoy is in flight. Each of the fins 18 may be characterized as an elongated fold having a corner angle of 90 degrees. In this example, each of the fins 18 pivots at its inward end around pivot 20, the latter being fixed to the rearward section 16. A cable 22 is connected between an attachment point 26 on a respective fin and the opposite cable end 24 coincides with the rear section 16 of the decoy.

Figure 2:
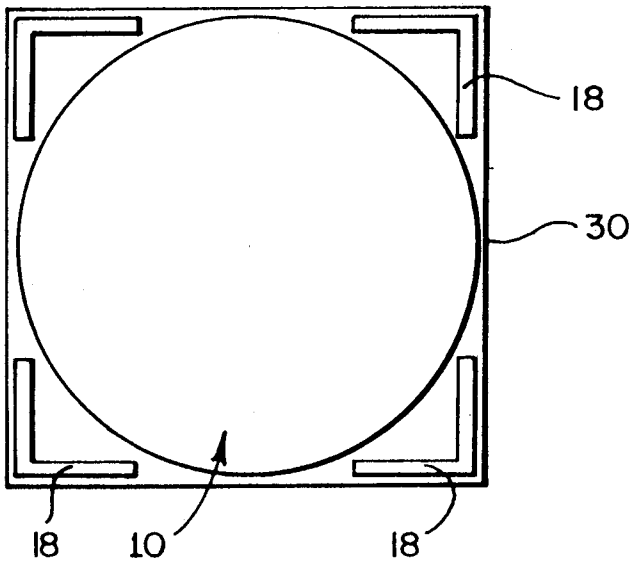
FIG. 2 is a simplified end diagrammatic view of a stowed decoy within a storage rack or canister.

During storage the decoy 10 may be positioned within a parallelopiped canister and each fin 18 may be collapsed to a position hugging the outer surface of the rear section 16, as indicated by reference numeral 19 in FIG. 1. This will allow the decoy to compactly fit within a parallelopiped canister of a nominal cross-sectional dimension approximating the diameter of the decoy. With the fins 18 collapsed, an end view of the decoy within the canister is schematically illustrated in FIG. 2. As will be observed in that figure, the right angle corner of each fin 18 coincides with the corner of the canister. Thus, no space is wasted and a very compact packaging results.

At maximum drag coefficient conditions, fin drag and elastic cable tension could be set to be balanced at a sweepback angle of approximately 45° aft of a plane perpendicular to the body centerline, with the fins inside corners facing the incoming wind.

In response to higher dynamic pressures and resulting increases in fin drag forces, the cable 22 stretches or extends by preselected additional distances which sweep the fins further aft. Approximating fin force variation as a cosine squared function, a 15° increase in sweepback angle to 60° will reduce drag levels to about one half the values which prevailed at 45° sweepback angle. Much larger modulations are obviously feasible, achieving large drag modulations with relatively small mechanical extensions.

To extend the elastic cable or restraint by the desired amount, a spring mechanism, diagrammatically illustrated by 23 is included between the inward ends of the schematic cables 22 and attachment points on the decoy rear section 16. Note that the force/extension relationship need not be linear, as in a simple spring. Compound springs, damping mechanisms to minimize opening shock loads, and other features needed to fulfill design requirements are well within the capabilities of one having skill in the art.

A cable 28 is secured between the nose cone section 12 of the decoy and a towing aircraft. Typically, the decoy is ejected from the canister 30 (FIG. 2) by means of a pyrotechnic charge (not shown). Thereafter, drag causes rapid extension of the fins to render the decoy aerodynamically stable while pulling and deploying cable 28. The drag forces on the fins will also cause extension of the telescoping sections 14 and 16. Construction of the present invention with telescoping sections enables a relatively long aerodynamic decoy to be dimensionally compressed within a canister having a smaller length.

According to the previous description of the invention, it will be appreciated that a design is offered for a compactly packaged cable-towed body which maintains stable flight at high and low altitudes, over a wide speed range, within cable tension limitations.

It should be noted that:

1) the fin layout presented here is superficially similar to a scheme used on "retarded" bombs. They deploy fins broadside to the wind with generally concave cross sections matching body contours. Their purpose is generally to steepen the bomb trajectory to avoid "skipping" and more particularly to increase, at low altitudes, the longitudinal distance between the launching aircraft and the bomb burst. These fins are deployed at set sweep forward angle, roughly 30°–40° from the body surface, not a variable sweepback angle as in the invention.

Their purpose is only to provide increased drag coefficient and bomb drag levels by some amount, severely constrained by stability requirements. The aerodynamic forces on the swept-forward fins, substantially normal to the fin chord plane, contribute to stability at low sweep angles off the body surface. Their stability contributions become smaller as sweep increases, become negligible when their resultant passes close to the center of gravity and turns adverse (forward of the C.G.) thereafter until it becomes quasi neutral when the fins are normal to the body center line and only small drag differences occur with angle of attack excursions (cosine squared terms).

They are not contributing to both drag and also favorable stability contributions in large amounts or readily adaptable to sweep angle modulations which characterize the invention, and are particularly useful for towed bodies.

2) Fin cross section, given as broadside to the incoming wind can, depending on design goals and/or constraints be either concave or convex. Concave cross sections give generally higher drag levels but can also introduce undesirable non linearities in the aerodynamic data or shock instabilities at supersonic speeds. The fins 18 of FIG. 2 could, for instance, be manufactured in two parts, hinged at the apex like a piano hinge, the whole assembly pivoted about the rear of the body in the described manner.

Then, they can be stowed as shown (90° concave) and after deployment open under loads to a preset angle determined by hinge geometry, which could easily be 90° convex.

Alternatively, a stiff spine of metal or fiber could stiffen the centerline of an elastically deformable flat sheet of the desired fin planform which could then be bent concave for stowage and become convex under air loads. This could be used to minimize opening shock loads and/or add another degree of drag modulation superposed on the spring restraint/sweep relationships.

3) The number of fins need not be an even number neither need all the fins be of equal span or similar cross sections, or set at identical sweep settings and sweep ranges. Indeed, an odd number of fins or asymmetrical fin arrangements may be desirable.

Then, the vertical and/or lateral offsets between the towing craft and the towed body can be biased in desired directions by selected asymmetries in fin arrangement or in fin radial orientation with respect to the tow cable attachment point. Decoys with different offsets could then be deployed simultaneously, with obvious advantages.

4) Body cross section shapes can be circular, ovoid or polygonal or in general any shape compatible with efficient packaging or other design requirements. Regular hexagon (honeycomb canister) or even triangular body cross sections are consistent with the invention.

5) The large drag modulation range resulting from fin sweep variations makes the invention particularly well suited to airborne towed bodies when air density changes have a strong influence on cable stability, as seen in the simple expression for cable stability:

$$S = 1.56 \frac{\mu}{\rho}$$

where S is the equivalent flat plate area $C_D S$ and $\mu$ and $\rho$ are the cable and the air densities respectively. It is easily seen that variations in $C_D S$ by factors of 2 or 3 easily compensate for altitude changes of 20–30,000 feet.

Even at constant densities, as in water, the invention is also useful for crafts with high speed ratios like hydrofoils or submarines which may operate between 5 and 50 knots for instance; a factor of 100 in dynamic pressures and decoy drag. Then, large sweep variations of 60 degrees or more can realistically reduce maximum cable loads by factors of 10 to 20, with related increases in operational envelopes.

6) Maneuvers will of course superpose excursions in cable tension superposed on steady state values. Even a constant radius horizontal turn at only 1.5 g can result in cable tension excursions between 1100 lbs. and 2200 lbs. Maneuvers in the vertical plane, e.g. loops or combined plane maneuvers which involve gravity result in even larger excursions. Towed bodies of the invention can be designed to give drag levels which will always decelerate it at a higher rate than the towing craft, even with dive brakes and/or reverse thrust. Cable tension at the decoy can then even exceed that at the towing aircraft, and avoid kinks and loops which would result in cable breaks when tension levels increase again.

7) At transonic/supersonic speeds, the normal force coefficients on surfaces broadside to the incoming stream corresponds to detached shock conditions and near maximum values of the coefficients for quasi two-dimensional high aspect ratio fin surfaces. These force coefficients increase with mach number instead of decreasing with increasing mach number like lift curve slopes, making the invention particularly suited for operations at supersonic speeds. Very stable tow has been demonstrated at $M=1.4$.

It should be understood that the invention is not limited to the exact details of construction shown and described herein for obvious modifications will occur to persons skilled in the art.

I claim:

1. A collapsible fin aerobody comprising:

a missile-shaped body;

a plurality of elongated fins having substantially perpendicular inner corners, each fin being pivotally mounted at an inner end thereof to the body for permitting the perpendicular corner of each fin to fold against the body when in a collapsed stored condition;

means connected between the body and each fin for restraining a deployed fin in a swept-back position relative to the body; and a tow cable connected to a forward point of the body.

2. The structure set forth in claim 1 together with a parallelopiped canister for storing the aerobody, outer corners of each collapsed fin snugly engaging the canister corners which extend along the length of the canister.

3. A towable aircraft decoy comprising:

a missile-shaped body;

a plurality of elongated fins having substantially perpendicular inner corners, each fin being pivotally mounted at an inner end thereof to the body for permitting the perpendicular corner of each fin to fold against the body when in a collapsed stored condition;

a cable connected between the body and each fin for restraining a deployed fin in a swept-back position relative to the body;

a tow cable connected to a forward point of the body; and means for effectively extending the length of the restraining cable forcing the fins to assume a greater swept position when a preselected drag threshold is exceeded.

4. The structure set forth in claim 3 together with a storage canister having a parallelopiped shape for storing the decoy with collapsed fins, outer corners of each fin snugly engaging the canister corners which extend along the length of the canister.

5. A body with deployable fins comprising:

a missile-shaped body;

a plurality of elongated fins, folded against the body in stowed position;

pivot means connected between the fins and the rear of the body for rotating the fins about the rear of the body upon deployment;

means connected between the body and a free end of each fin to restrain a deployed fin in a sweepback position relative to the body; and a tow cable connected to a point of the body, generally above and forward of the center of gravity.

6. The structure set forth in claim 5 together with a canister for storing the body, outer contours of each stowed fin snugly matching the available space between the body and canister corners which extend along the length of the canister, the towed body cross section being of geometrically similar cross section.

7. The subject matter set forth in claim 5 wherein the cable is attachable to a towing craft.

8. A towable body comprising:

a missile-shaped body;

a plurality of elongated fins folded against the body in a stowed position;

pivot means connected between the fins and the rear of the body for rotating the fins about the rear of the body upon deployment;

a tow cable connected to a point of the towed body, generally above and forward of the center of gravity;

a mechanical restraint connected between the body and each fin, restraining a deployed fin in a swept-back position relative to the body;

means for effectively extending the length of the mechanical restraint when a preselected fin force threshold is exceeded to reduce fin forces within desired levels.

9. A towable body of claim 8 where the fins include means along the fin cross section to orient each fin to a convex cross section in the deployed position.

* * * * *